United States Patent [19]

Vigueras Pacheco

[11] Patent Number: 4,765,460

[45] Date of Patent: Aug. 23, 1988

[54] KEY RING-PILL HOLDER CONTAINER

[76] Inventor: Rafael Vigueras Pacheco, Urbanización Puente Romano, Merida (Badajoz), Spain

[21] Appl. No.: 48,040

[22] Filed: May 11, 1987

[30] Foreign Application Priority Data

May 12, 1986 [ES] Spain ..... 294099
May 5, 1987 [ES] Spain ..... 8701514

[51] Int. Cl.[4] ..... B65D 81/36; B65D 83/04

[52] U.S. Cl. ..... 206/38.1; 70/456 R; 206/38; 206/536; 206/538

[58] Field of Search ..... 7/167–170; 81/488; 70/456 R; 206/38, 38.1, 528, 535–539; 215/350

[56] References Cited

U.S. PATENT DOCUMENTS 1,889,471 11/1932 Glaenzer ..... 206/38.1
3,251,459 5/1966 Lacour ..... 206/537
3,263,804 8/1966 Marenchin ..... 70/456 R
3,968,902 7/1976 Bachmann ..... 206/537
4,129,228 12/1978 Stoneback ..... 215/350

FOREIGN PATENT DOCUMENTS 0222813 1/1962 Austria ..... 206/537
2024002 1/1980 United Kingdom ..... 70/456 R

*Primary Examiner*—Jimmy G. Foster
*Attorney, Agent, or Firm*—Ladas & Parry

[57] ABSTRACT

A key-ring/pill-holder for carrying keys and pills has a musket-type key ring having an attachment device for attaching the key ring to a garment, a key-attachment element for attaching a key, and a body having faces longitudinally therebetween. The pill holder is a cavity opening from one of the faces of the body of the key ring for holding pills and a sealing cap for closing the cavity opening and easily opening the same, whereby to provide a compartment for the pills until desired.

20 Claims, 2 Drawing Sheets

KEY RING-PILL HOLDER CONTAINER

The invention refers to a key-ring/pill-holder which accomplishes these two, name functions are the same time.

It is well known, with the current way of living, a great number of people, especially so-called executives, experience stress and, in many cases, myocardial infarct. Other people also suffer from myocardial infract, angina pectoris or other coronary diseases or have a tendency thereto. Many other people, although not having any such diseases, recognize that this does not mean that they cannot suffer from them at any given moment. These people take measures so that, when there might be a sign of such, they are prepared with an appropriate medicinal pill that may save their lives, provided they take it at that moment the sign appears. With this aim, these people carry containers of such pills as a preventive measure.

Because the pills are only carried as a preventive measure, and not as a medicinal treatment, however, carrying their containers becomes too uncomfortable to too much of a nuisance.

The object of this invention is, therefore, a device for the user to carry permanently certain kinds of pills without being bothered thereby, because the pills are in a key ring which, in another type, the user permanently carried anyway.

To this end, the key-ring/pill-holder of the invention is a classical musket-type key ring, with an element to attatch it to the user's belt and a key-attachment element, but with the musket body longitudinally provided, in correspondence with one of its faces, with a cavity or slots and a sealing cap for the pills. Thus, if the user needs the pills at any given moment, he will only have to get the key ring to get it.

The material from which the key-ring/pill-holder is made is an adequate one allowed by the local Sanitary Authority, with the peculiarity, however, that the faces constituting the body of such can incorporate inscriptions, indications, laboratory logotypes or any kind of advertising one wishes.

In a preferred embodiment of the invention, the group of slots or cavity provided in the body of such a key ring has some walls or projections emerging from its bottom, which define compartments for the pills. The bottom is also occupied by a spongy material that urges the pills outwards, the pills being restrained from doing so by the cap, when the latter is in the closed position.

In another preferred embodiment of the invention, the group of slots or cavity is completely diaphanous, i.e. open, as used herein, and the pills, in this case, are randomly located therein.

In still another preferred embodiment of the invention, said group of slots or cavity is occupied by a prismatic textile and spongy material body provided with holes. The holes determine locations for respective pills, said locations having either a circular, oval or any other configuration which is adequate for the shape and configuration of the pills to be contained.

The group of slots or cavity may open from one of the minor faces or on one of the major faces.

Another peculiarity of the object of the invention resides in that the closure cap is guided on slots in the inner lateral walls of the group of slots or cavity at an upper part or mouth of said cavity or slots. For sealing, it may have a thoracic joint for each of the mouths of compartments defined by the slots or, when the slots are shared, by a flat piece of an adequate material fixed on the inner or lower face of the cap, thereby achieving perimetric closure of the whole group of slots.

A seal also may be achieved without any sealing element, this being achieved by the nature of the materials from which the body of the key ring and the cap are made. There are materials which, due to their nature, can form by themselves the intended seal.

In order to complete the following description and to help a better comprehension of the characteristics of the invention, the present specification has an attached set of drawings, the figures of which represent the following:

Figure 1:
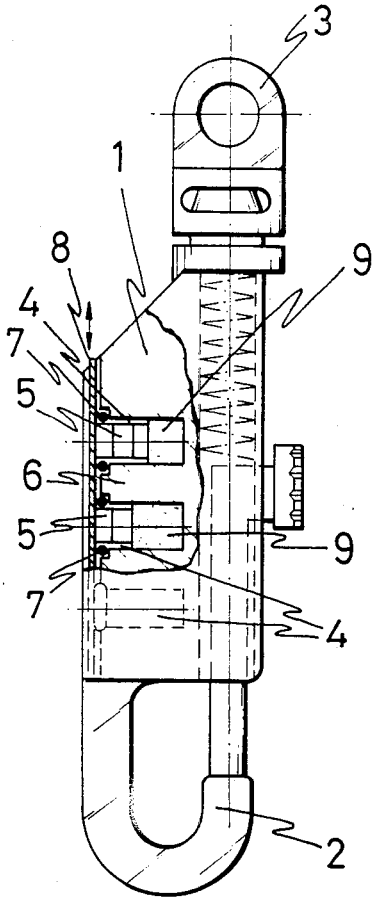
FIG. 1 is an elevational lateral view of one embodiment according to the invention, wherein a part thereof has been sectioned in order to show clearly pill locations.
Figure 2:
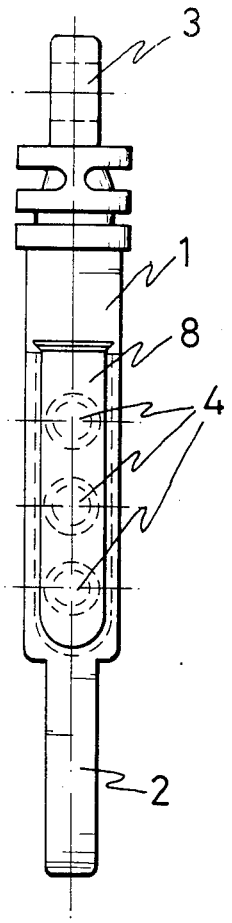
FIG. 2 is an elevation view of the left side of the embodiment represented in FIG. 1.

In view of the above figures and specifically referring to FIG. 1 and 2, it can be seen how the key-ring/pill-holder according to the invention is constituted from a body 1 made from any adequate material in the shape of the classical musket-type key ring. At one of its ends is an attachment system 2 for attaching it to any garment, such as a belt or the like. At the opposite end, the body 1 forms a ring or any other attachment means to carry the usual keys.

Whatever the general shape of the body 1 may be, one of its faces and, specifically, one the minor faces, has slots or compartments 4, each for containing one or more pills 5, as clearly shown in FIG. 1. Between the slots 4, separating walls 6 are defined.

The mouth of each slot 4 incorporates a thoracic joint 7 so that all the joints 7 are pressed by a cap 8 that opens by sliding. For this, the cap is guided by its lateral edges in respective guides or channels provided at the mouths of the slots in the corresponding face of the body 1.

In other embodiments (not shown), the cap 8 may be constituted in other ways, so long as it allows a sealing position and easy opening from the sealing position, such as shown in FIG. 1, in which pressing against the thoracic joints 7, seals the slots 4 wherein the pills 5 are situated.

At the bottoms of said slots 4 are some spongy or stuffed bodies 9, the expansion of which constantly urges the pills 5 upward. That is to say, that said spongy bodies 9 always tend to push the pills 5 towards the mouths, so that, when to cap 8 is in the closure position, the pills are always pressed against the cap 8, which restrains them from moving inside their slots 4 and thus avoids damage thereof.

Figure 3:
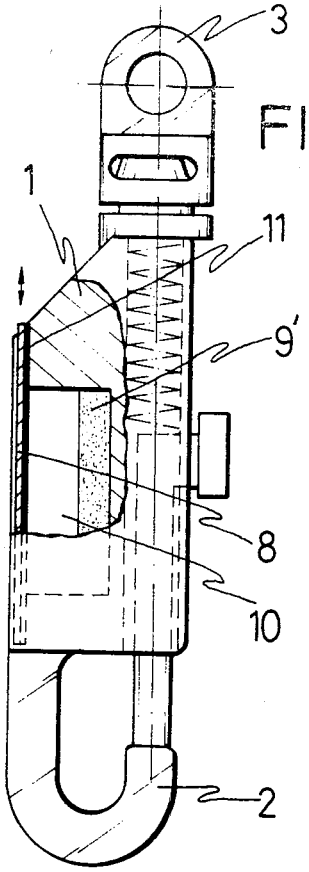
FIG. 3 is a view similar to that of FIG. 1 of another embodiment wherein a group of slots or cavity is diaphanous, i.e., has no inner partitions.

In the variant embodiment shown in FIG. 3, one of the minor faces of the body 1 is provided with a completely diaphanous cavity or group of slots 10, at the bottom of which a corresponding stuffed piece 9 is located. The diaphanous group of slots 10 allow random location of the pills.

In this case, the cap 8 is constituted in the same way as that of FIG. 1, and guided on corresponding channels provided near the mouth in the side walls of the diaphanous slots. The seal of such a group of slots 10 is achieved by a thin piece 11 of an adequate material fixed on the inner or lower face of the cap 8, as clearly shown in FIG. 3.

Figure 4:
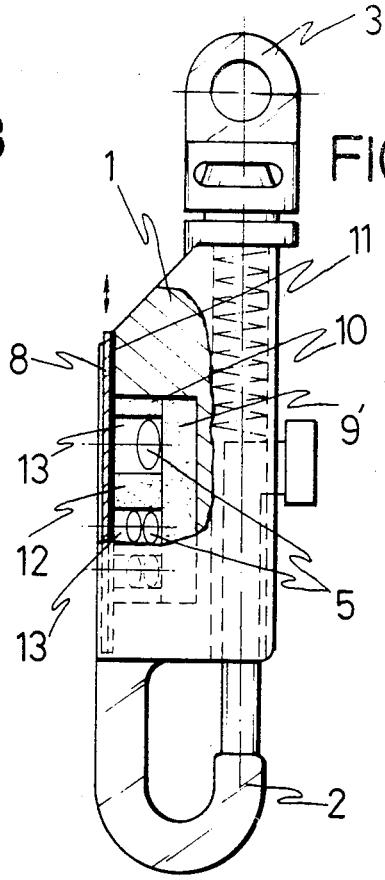
FIG. 4 is a view similar to that of FIG. 1 of still another embodiment with a diaphanous group of slots or cavity, like that of FIG. 3, but with a prismatic, textile and spongy body therein with holes for defining pill locations.

In FIG. 4, an embodiment the same as in FIG. 3 is shown, except that the group of slots 10 is occupied by a prismatic, textile or spongy piece 12, with holes 13 for the location of corresponding pills 5. It also has, however, a stuffed bottom 9' and sealing cap 8 with sealing piece 11.

Figure 5:
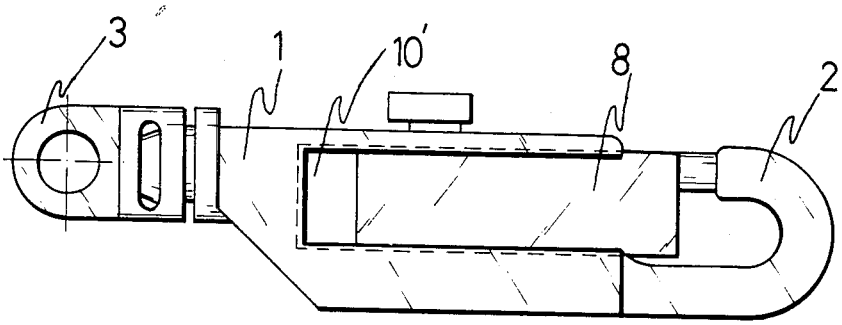
FIG. 5 is a view similar to that of FIG. 1 of still another embodiment wherein the group of slots or cavity is one of the major faces thereof.

FIG. 5 shows another variant embodiment wherein the group of slots 10' is on one of the major faces. It is provided in this case, as in the previous one, with a sealing cap 8, which is also guided is channels in the side walls of the group of slots near the upper edge or mouth of the very group of slots 10'.

The material from which the key-ring/pill-holders described above are made may be any one, from metal to an adequate plastic, so that, in certain cases and due to the nature of the material, the seal may be achieved by itself, with no need of the aforementioned sealing pieces.

A container is achieved in this way, which, because a key ring, the user will be able to carry permanently with him, thereby being able to carry the corresponding pills 5 as well as precaution for a possible infarct or any other type of disease for which it is necessary to take a medicinal pill immediately in order to avoid the possibility of death.

I claim:

1. A key-ring/pill-holder for carrying keys and pills, comprising:

a musket-type key ring having attachment means for attaching the key ring to a garment, key-attachment means for attaching a key, and a body having faces longitudinally therebetween; and a pill holder comprising a cavity opening from one of the faces of the body of the key ring for holding pills and a sealing cap means for closing the cavity opening and easily opening the same, whereby to provide a compartment for the pills until desired.

2. The key-ring/pill-holder of claim 1, wherein the faces of the body of the key ring are major and minor faces, and the one of the faces having the cavity opening is a minor face.

3. The key-ring/pill-holder of claim 1, wherein the faces of the body of the key ring are major and minor faces, and the one of the faces having the cavity opening is a major face.

4. The key-ring/pill-holder of claim 1, wherein the sealing cap comprises the materials of the cap and the body for self sealing the cavity when the cap is closed.

5. The key-ring/pill-holder of claim 1, and further comprising at least one wall projecting from the bottom of the cavity, opposite the sealing cap, for defining compartments for holding the pills.

6. The key-ring/pill-holder of claim 5, wherein the faces of the body of the key ring are major and minor faces, and the one of the faces having the cavity opening is a minor face.

7. The key-ring/pill-holder of claim 5, wherein the faces of the body of the key ring are major and minor faces, and the one of the faces having the cavity opening is a major face.

8. The key-ring/pill-holder of claim 5, wherein the sealing cap comprises the materials of the cap and the body for self sealing the cavity when the cap is closed.

9. The key-ring/pill-holder of claim 5, and further comprising a spongy body on the bottom of at least one of the compartments of the cavity defined by the wall projection.

10. The key-ring/pill-holder of claim 9, wherein the faces of the body of the key ring are major and minor faces, and the one of the faces having the cavity opening is a minor face.

11. The key-ring/pill-holder of claim 9, wherein the faces of the body of the key ring are major and minor faces, and the one of the faces having the cavity opening is a major face.

12. The key-ring/pill-holder of claim 9, wherein the sealing cap comprises the materials of the cap and the body for self sealing the cavity when the cap is closed.

13. The key-ring/pill-holder of claim 1, and further comprising a prismatic, textile and spongy body in the cavity having holes therein for defining locations of the pills.

14. The key-ring/pill-holder of claim 13, wherein the faces of the body of the key ring are major and minor faces, and the one of the faces having the cavity opening is a minor face.

15. The key-ring/pill-holder of claim 13, wherein the faces of the body of the key ring are major and minor faces, and the one of the faces having the cavity opening is a major face.

16. The key-ring/pill-holder of claim 13, wherein the sealing cap comprises the materials of the cap and the body for self sealing the cavity when the cap is closed.

17. The key-ring/pill-holder of claim 1, and further comprising a spongy body on the bottom of the cavity, opposite the sealing cap.

18. The key-ring/pill-holder of claim 17, wherein the faces of the body of the key ring are major and minor faces, and the one of the faces having the cavity opening is a minor face.

19. The key-ring/pill-holder of claim 17, wherein the faces of the body of the key ring are major and minor faces, and the one of the faces having the cavity opening is a major face.

20. The key-ring/pill-holder of claim 17, wherein the sealing cap comprises the materials of the cap and the body for self sealing the cavity when the cap is closed.

* * * * *